US006526882B1

(12) United States Patent
Shih

(10) Patent No.: US 6,526,882 B1
(45) Date of Patent: Mar. 4, 2003

(54) FOUNTAIN STAMP

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 09/984,110

(22) Filed: Oct. 29, 2001

(51) Int. Cl.[7] ..... B41K 1/50
(52) U.S. Cl. ..... 101/327; 101/333; 101/405
(58) Field of Search ..... 101/327, 333, 101/334, 405, 406, 103; 401/195; D18/14, 15

(56) References Cited

U.S. PATENT DOCUMENTS 2,627,227 A * 2/1953 Claggett ..... 101/333
2,920,559 A * 1/1960 Becker ..... 101/405
4,676,162 A * 6/1987 Phipps et al. ..... 101/405
6,290,419 B1 * 9/2001 Hirschmann ..... 401/195

* cited by examiner

*Primary Examiner*—Leslie J. Evanisko
(74) *Attorney, Agent, or Firm*—Rosenberg, Klein & Lee

(57) ABSTRACT

A fountain stamp includes a body having a connecting rod, a base plate pivotally connected to the connecting rod, an ink container detachably attached to the base plate. A torsion spring is mounted around an axle connecting the base plate and the connecting rod to provide resilience to the base plate. The ink container for storing ink also receives an ink pad and a stamping plate inside. The ink permeates through the ink pad and moistens a stamping surface of the stamping plate. The fountain stamp further includes a housing to receive the base plate and the stamping plate.

8 Claims, 6 Drawing Sheets

FOUNTAIN STAMP

BACKGROUND OF THE INVENTION

1. Field of the Invention

The present invention relates to a stamp, and more particularly to a fountain stamp that is able to operate without an external stamp pad. Moreover, the fountain stamp is specially designed to prevent ink from staining a user's hand or clothing.

2. Description of Related Art

A stamp is a kind of tool that people would use to press or print a mark or pattern onto a surface. One kind of stamp that is popular especially in the eastern-world is used for printing a person's name onto, for example, a document in lieu of a handwritten signature. However, to use the stamp requires a stamp pad for applying ink onto a face of the stamp. A user may forget to bring the stamp pad when needed or feel it is inconvenient to carry the stamp pad. Furthermore, after the stamp has been used, residue of the ink may easily stain the user's hand or clothing. Therefore, an improvements on the conventional stamp is needed.

With reference to FIGS. 7, 8 and 9, a portable stamp is invented to overcome the aforementioned shortcomings. The portable stamp includes a body (50) and a housing (60) for receiving the body (50). A connecting plate (51) outwardly extends from a bottom portion of the body (50) and has a cutout (511) defined through a distal end of the connecting plate (51). A rotatable plate (52) is pivotally connected the distal end of the connecting plate (51) via a first hinge (512) while the cutout (511) provides a space for the rotatable plate (52) to be able to pivot freely. A stamp plate (53) having a face formed with a pattern is firmly attached to a side of the rotatable plate (52). A connecting arm (55) extending parallel to the connecting plate (51) is pivotally connected to the bottom portion of the body (50) via a second hinge (54). A retaining plate (56) is further securely connected to the connecting arm (55) and securely mounted with a stamp pad (57). The stamp pad (57) contains ink so that when the body (50) is stored inside the housing (60), as shown in FIG. 7, the stamp pad (57) engages with the face of the stamp plate (53) and thereby applies the ink onto the face.

With reference specifically to FIG. 9, when in operation, the body (50) is pulled out of the housing (60) and the rotatable plate (52) is manually pivoted to a proper angle for stamping. However, the portable stamp has the following disadvantages:

1. The connection between the connecting plate (51) and the rotatable plate (52) is not secured and no positioning means is provided to hold the rotatable plate (52) in place. Therefore, the rotatable plate (52) may undesirably pivot and affect the performance of the portable stamp during stamping.

2. After several consecutive times of stamping, reapplying of the ink is required, due to the stamp plate (53) becoming exhausted of ink. A user has to manually engage the stamp plate (53) with the stamp pad (57). Similarly, when storing the body (50) into the housing (60), the user also has to manually engage the stamp plate (53) and the stamp pad (57) in order to receive the body (50) in the housing (60). These engaging procedures mentioned may easily cause staining of the user's hand and clothing.

Therefore, it is an objective of the invention to provide an improved fountain stamp to mitigate and/or obviate the aforementioned problems.

SUMMARY OF THE INVENTION

An objective of the present invention is to provide a fountain stamp having a base plate and a stamping plate receivable into a housing so that the fountain stamp can be conveniently carried around. Moreover, the base plate is provided with a torsion spring such that when the base plate and the stamping plate are pulled out of the housing, the stamping plate is able to be pivoted automatically to an angle suitable for stamping.

Another objective of the present invention is to provide a fountain stamp having an ink container for storing ink that permeates through an ink pad and moistens the stamping plate so that the ink is automatically applied onto a stamping face of the stamping plate.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1–4, a fountain stamp in accordance with the present invention includes a hollow body (10), a housing (20), a base plate (30), and an ink container (40).

Figure 2:
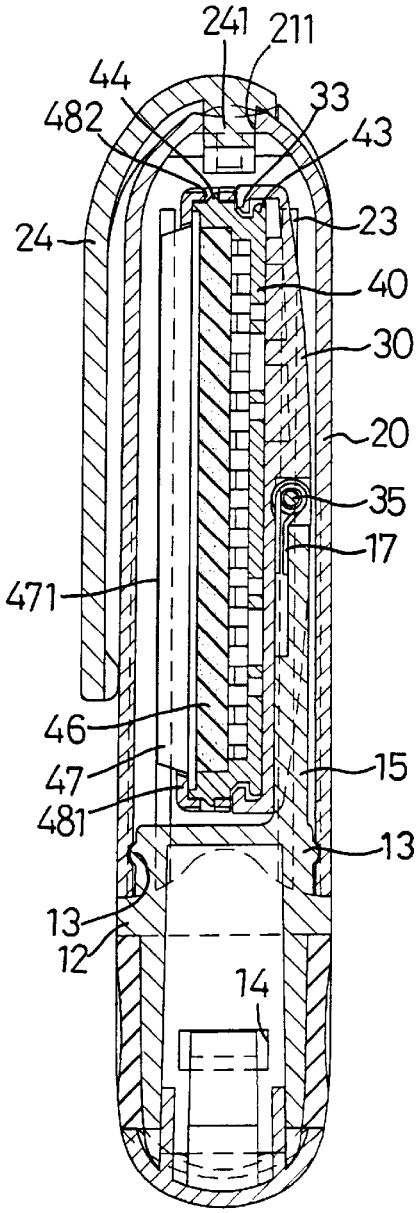
FIG. 2 is a cross-sectional, side view of the fountain stamp.

The hollow body (10) has an annular protrusion (12) formed around an upper portion of the body (10). Two slots (14) are respectively defined through opposite sides of the hollow body (10). Two protuberances (13), as clearly shown in FIG. 2, are also respectively defined through opposite faces of the upper portion of the body (10). A connecting rod (15) is upwardly extending from a top surface of the body (10). Two ears (16) juxtaposed with each other are formed on a free end of the connecting rod (15). Two axle holes (161) are respectively defined through the ears (16) and are aligned with each other. The connecting rod (15) also has a socket (152) defined near the ears (16) and along a longitudinal direction of the hollow body (10). The housing (20) is hollow and has an open bottom end. A concavity (21) is defined in a top end of the housing (20). A stub hole (211) is defined in a face defining the concavity (21). Two pin holes (212) are respectively defined in the face defining the concavity (21) and spaced by the stub hole (211). Four guiding ridges (23) are distributed in an inner face of the housing (20) and extending along a longitudinal direction of the housing (20). A clipping piece (24) has a banded end and is assembled onto the housing (20). Two pins (242) and a stub (241) are formed in the banded end, wherein the stub (241) is formed to correspond to the stub hole (211) and the pins (242) are formed to correspond to the pin holes (212) so that the stub (241) is able to extend into the corresponding stub hole (211) and the pins (242) are able to extend into the corresponding pin holes (212) to secure the engagement of the clipping piece (24) with the housing (20).

The base plate (30) has a recess (31) longitudinally defined in the base plate (30) to correspond to the connecting rod (15). Guiding troughs (32) are defined in a rear side of the base plate (30) to correspond to the guiding ridges (23). A hook (33) is formed on a top edge and a bottom edge of the base plate (30). An axle (35) is provided to transversely extend through the base plate (30) and the axle holes (161) of the ears (16) so as to pivotally connect the base plate (30) with the connecting rod (15). A torsion spring (17) is further mounted around the axle (35), and having two feet respectively abutted to surfaces defining the recess (31) and the socket (152).

The ink container (40) is securely attached to rear side face of the base plate (30). A notch (45) is defined in a lateral side of the ink container (40) to correspond to the bar (34) of the base plate (30). Two projecting edges (43) are respectively formed on a top side and a bottom side of the ink container (40) and mate with the hooks (33). Two ribs (44) are also respectively formed in a top side and a bottom side of the ink container (40). Two refill holes (41) are defined through a backside of the ink container (40) for a further supply of ink. The ink container (40) is hollow and has a front opening to receive an ink pad (46) which is able to absorb and store the ink. A stamping plate (47) made of a permeable substance is attached to an outer side of the ink pad (46). The stamping plate (47) has a stamping surface (471) formed with a pattern to be printed onto, for example, a document. A frame (48) is mounted around the ink container (40). A flange (481) is formed around an inner surface of the frame (48). Two slits (482) are respectively defined in a top portion and a bottom portion of the frame (48) and corresponding to the ribs (44). The frame (48) secures the stamping plate (47) and the ink pad (46) inside the ink container (40) by mating of the ribs (44) with the slits (482) and engaging the flange (481) with a peripheral edge surrounding the stamping surface (471).

When refilling the stamp, the ink container (40) is detached from the base plate (30), and refilled with fresh ink travelling into the refilling holes (41). After the ink is stored in the ink container (40), the ink moistens the ink pad (46) and further permeates into the stamping pad (47). Therefore, the stamping surface (471) is moist with the ink and is ready to be used.

Figure 5:
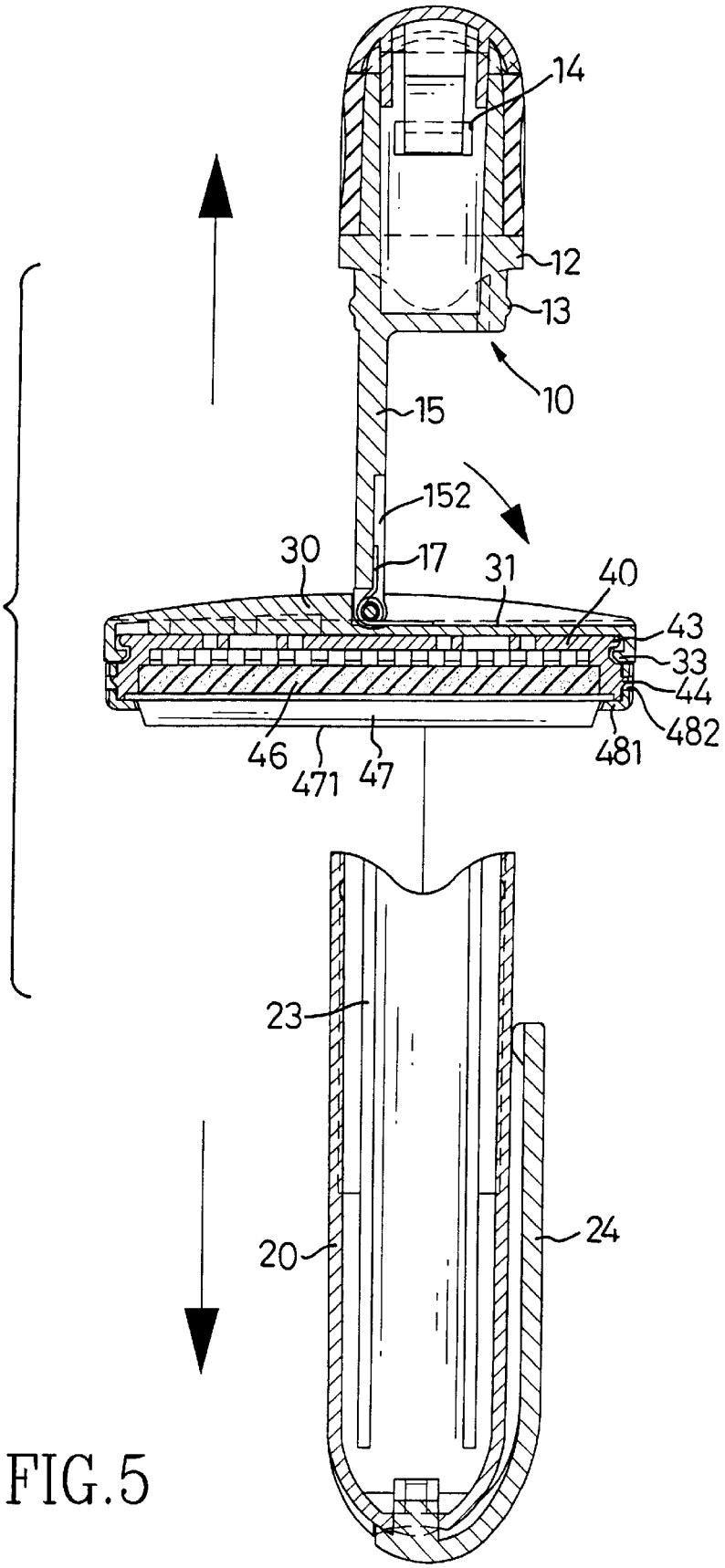
FIG. 5 is an operational, cross-sectional view of the fountain stamp, wherein a body, a base plate, and a stamping plate are separated from a housing.

With reference to FIG. 5, when in operation of the fountain stamp, a user pulls the body (10) as well as the base plate (30) and the ink container (40) out of the housing (20). Due to the resilience provided by the torsion spring (17), the base plate (30) and the stamping plate (47) turn 90 degrees automatically and are secure in this position in order to perform stamping.

Figure 1:
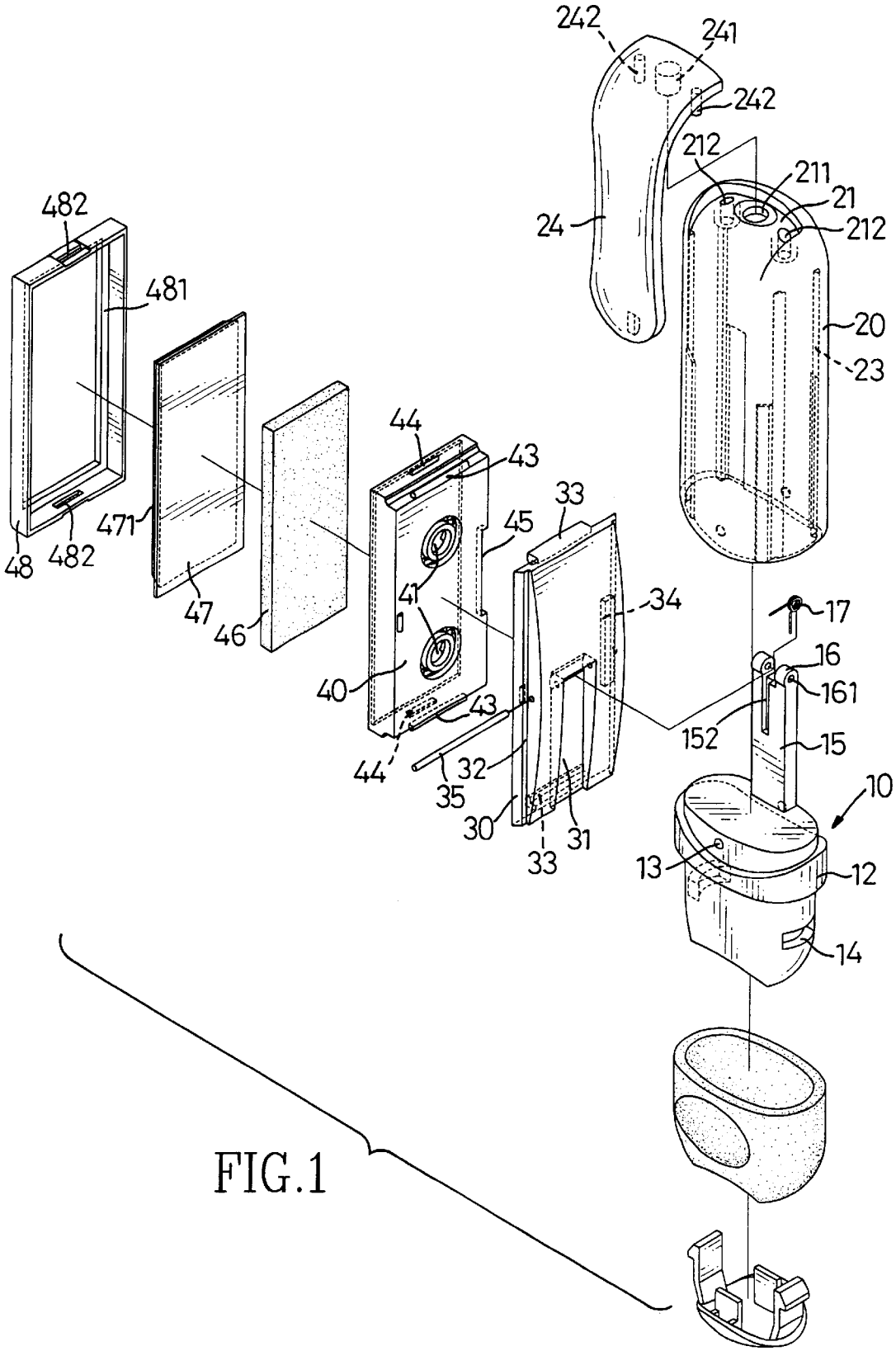
FIG. 1 is an exploded, perspective view of a fountain stamp in accordance with the present invention.
Figure 4:
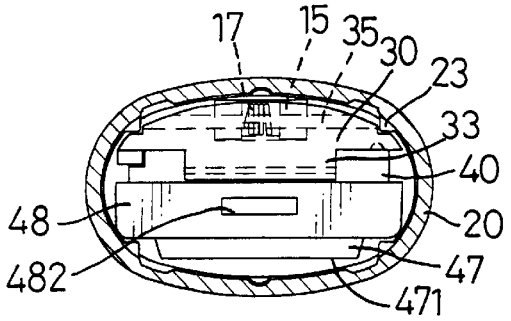
FIG. 4 is a cross-sectional, top view of the fountain stamp.
Figure 3:
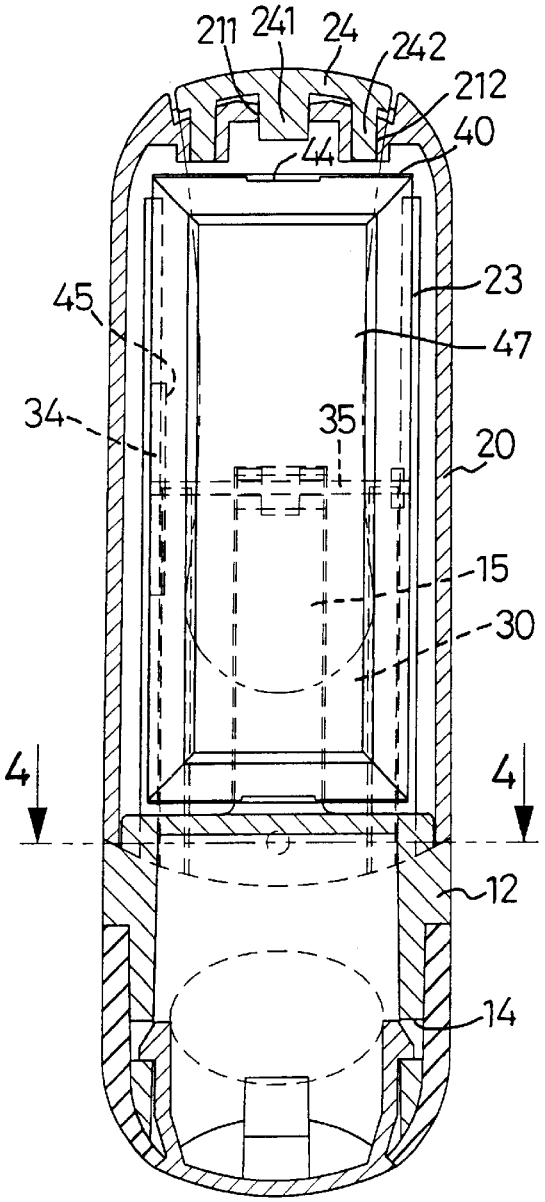
FIG. 3 is a cross-sectional, font view of the fountain stamp.
Figure 6:
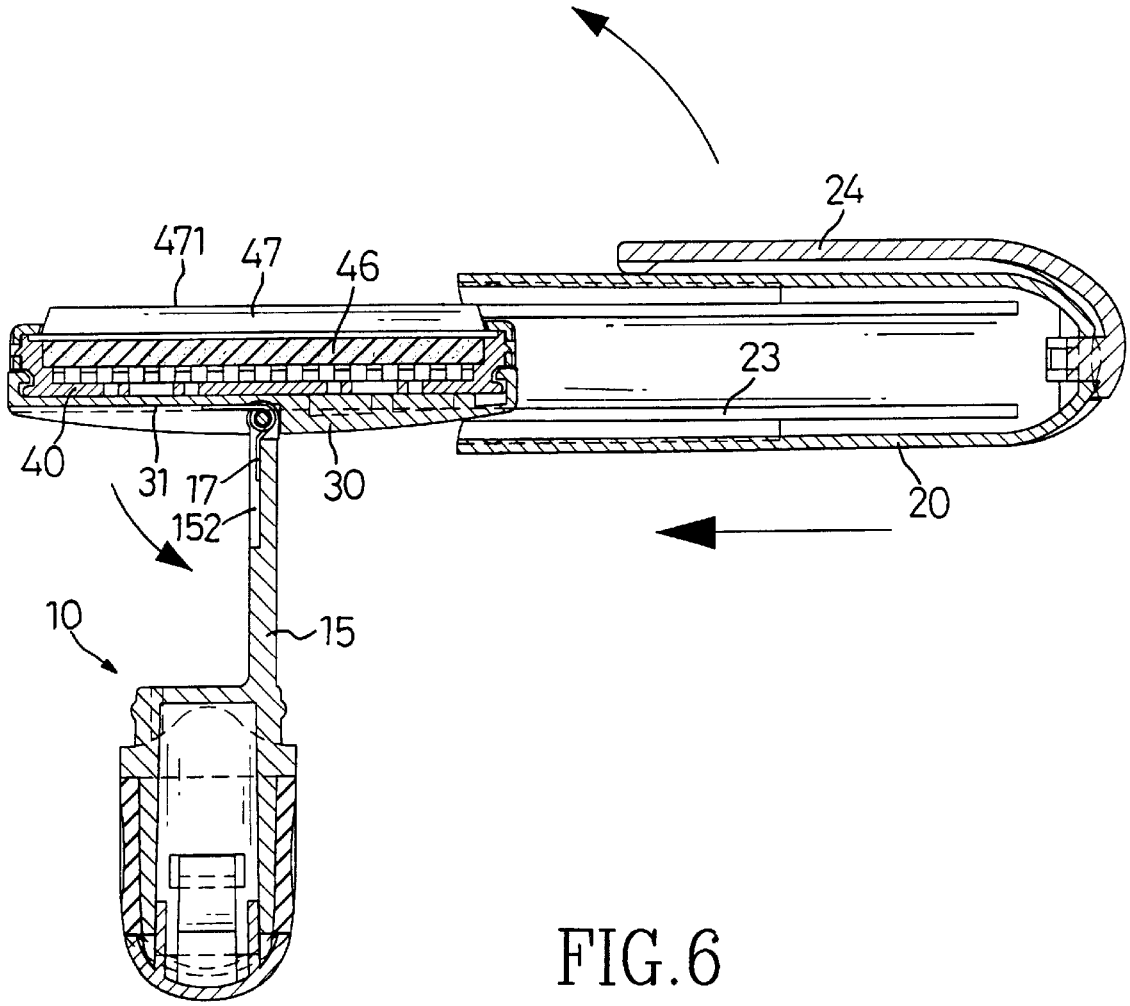
FIG. 6 is an operational, cross-sectional view of the fountain stamp, wherein the base plate and the stamping plate are entering the housing.
Figure 7:
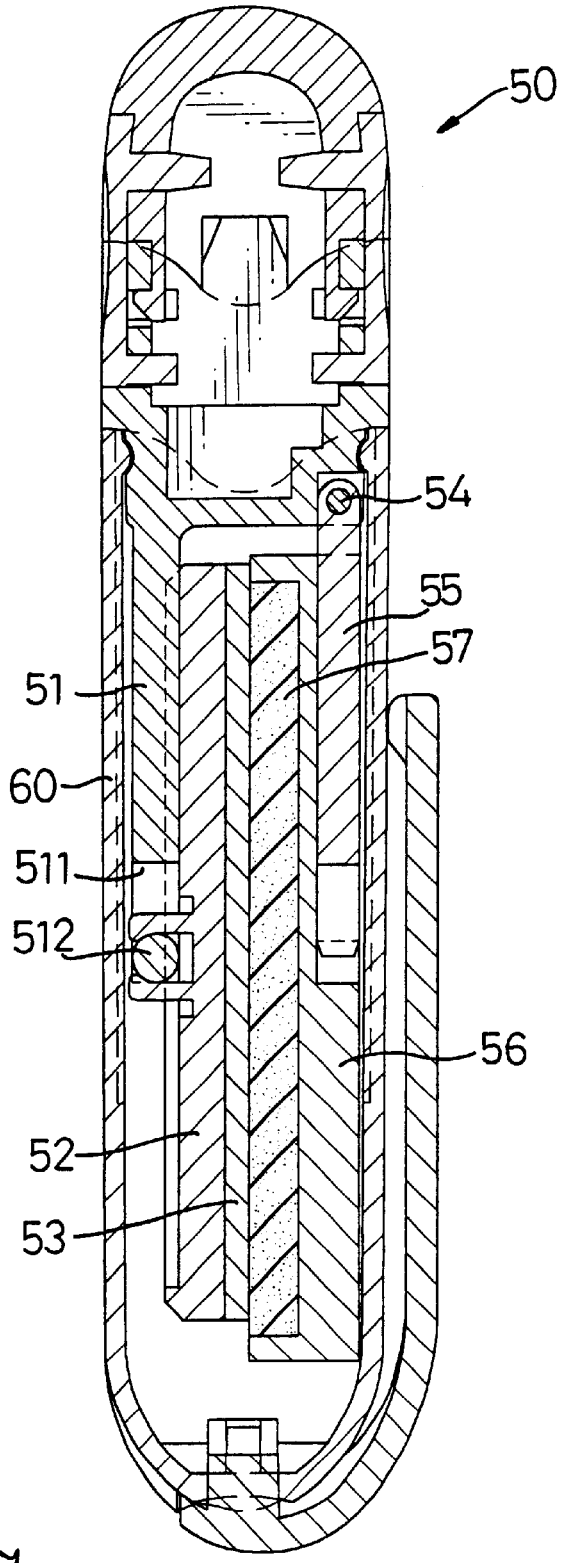
FIG.7 PRIOR ART
FIG. 7 is a cross-sectional view of a conventional portable stamp.
Figure 8:
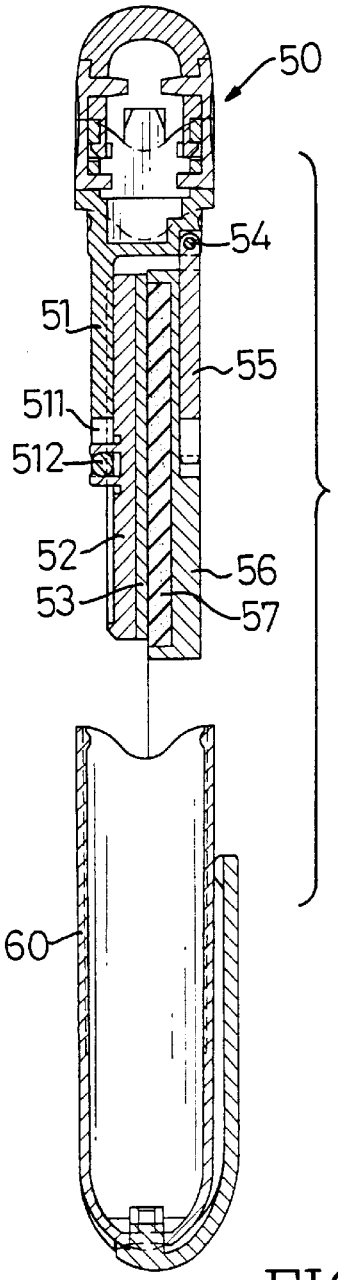
FIG.8 PRIOR ART
FIG. 8 is a cross-sectional view of the conventional portable stamp, wherein a body is separated from the housing.
Figure 9:
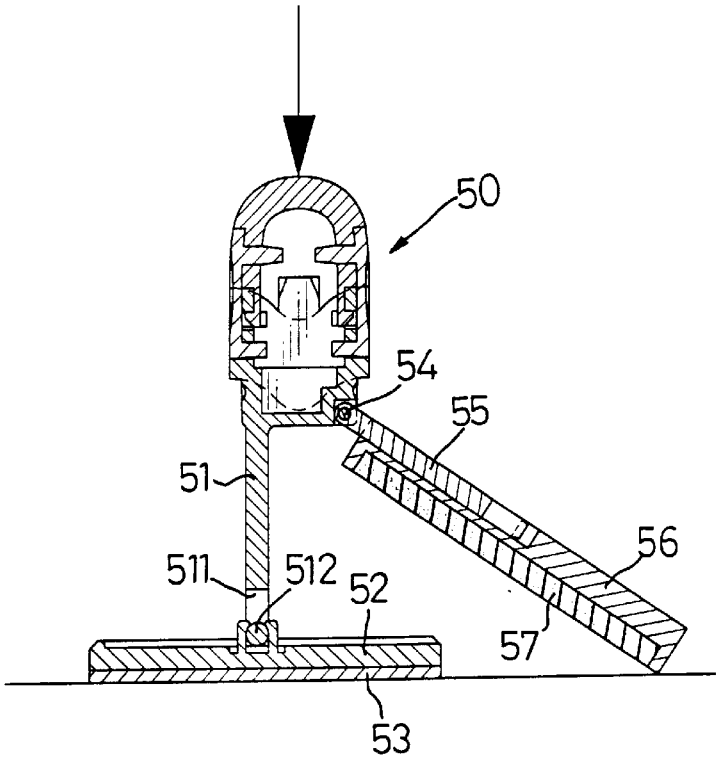
FIG.9 PRIOR ART
FIG. 9 is an operational, cross-sectional view of the conventional portable stamp during a stamping operation.

With reference to FIG. 6, when the fountain stamp is not in use, the base plate (30) and the ink container (40) slide into the housing (20) while guided by the guiding ridges (23). The user further exerts a suitable force to overcome the torsion spring (17) and pivots the body (10) so as to be received the base plate (30) and the stamping plate (47) inside the housing (20) as shown in FIGS. 2 and 3. It is noted that during this receiving procedure, the user does not have to touch the stamping surface (471) and thus the user's hand is prevented from being stained by the ink. It is also noted that when the body (10), the base plate (30) and the stamping plate (47) are completely received inside the housing (20), the fountain stamp is ready to be carried around without the risk of the user's clothing becoming stained.

Besides the advantage of not staining the user's hand and clothing, another advantage of the present invention is that the ink container (40) stores the ink required to perform a stamping operation. Therefore, an external stamp pad for applying ink onto a traditional stamp before stamping is no longer required. Moreover, the ink container (40) has the capacity of carry an amount of ink enough for multiple stamping operations and the ink permeates and automatically moistens the stamping face (171). Therefore, reapplying the ink every time before stamping as is required by conventional stamps is no longer required.

Furthermore, it should be appreciated that the stamping plate (47) is interchangeable. Different stamping plates having stamping faces formed with various patterns can replace the stamping plate (47). Therefore, the user can easily change the stamping plate (47) to change the pattern to be printed and do not have to purchase an entire stamp.

While this invention has been particularly shown and described with references to the preferred embodiment thereof, it will be understood by those skilled in the art that various changes in form and details may be made therein without departing from the scope of the invention encompassed by the appended claims.

What is claimed is:

1. A fountain stamp comprising:

a body having a connecting rod extending from the body;

a base plate pivotally connected to a distal end of the connecting rod;

an ink container detachably engaged with the base plate, and having at least one refilling hole defining through a side of the ink container and communicating with a hollow interior of the ink container;

an ink pad received inside the hollow interior of the ink container;

a stamping plate attached to the ink pad and made of a permeable substance, the stamping plate having, a stamping surface formed with a pattern; and a housing having an open bottom end to receive the base plate and the stamping plate.

2. The fountain stamp as claimed in claim 1, wherein the base plate and the extending rod are pivotally connected using an axle, and a torsion spring is further mounted around the axle to provide resilience to the base plate.

3. The fountain stamp as claimed in claim 2 further comprising a socket defined in the connecting rod and near the distal end of the connecting rod and a recess defined in the base plate, wherein the torsion spring has two feet respectively abutted to surfaces defining the socket and the base plate.

4. The fountain stamp as claimed in claim 3 further comprising a frame mounted around the base plate and having a flange formed around an inner surface of the frame, the flange engaging the stamping plate so as to secure the ink pad and the stamping plate onto the ink container.

5. The fountain stamp as claimed in claim 4, wherein multiple guiding ridges are formed on an inner face of the housing to guide the base plate to slide into the housing.

6. The fountain stamp as claimed in claim 5, wherein multiple guiding troughs are defined in a rear side of the base plate to correspond to the guiding ridges.

7. The fountain stamp as claimed in claim 6 further comprising a clipping piece attached to and extending from the housing so that the fountain stamp is able to be conveniently carried around.

8. The fountain stamp as claimed in claim 1 further comprising a frame mounted around the base plate and having a flange formed around an inner surface of the frame, the flange engaging the stamping plate so as to secure the ink pad and the stamping plate onto the ink container.

* * * * *